US007021786B1

(12) United States Patent
Sandor, Sr.

(10) Patent No.: US 7,021,786 B1
(45) Date of Patent: Apr. 4, 2006

(54) ILLUMINATED GLASS DECK LIGHT PANEL AND METHOD OF INSTALLATION

(76) Inventor: Frederick J. Sandor, Sr., 407 St. Georges Ct., Satellite Beach, FL (US) 32937

( * ) Notice: Subject to any disclaimer, the term of this patent is extended or adjusted under 35 U.S.C. 154(b) by 259 days.

(21) Appl. No.: 10/614,383

(22) Filed: Jul. 7, 2003

Related U.S. Application Data

(63) Continuation-in-part of application No. 10/086,965, filed on Mar. 4, 2002, now abandoned.

(51) Int. Cl.
*F21S 8/00* (2006.01)

(52) U.S. Cl. ..... 362/153; 362/153.1; 362/145

(58) Field of Classification Search ..... 362/153.1, 362/153, 145, 146, 152, 559, 560, 576, 240, 362/252, 364; 52/28, 87; 404/22, 23
See application file for complete search history.

(56) References Cited

U.S. PATENT DOCUMENTS 312,269 A * 2/1885 Higley ..... 362/153
1,385,688 A * 7/1921 Keppler ..... 404/21
1,572,214 A * 2/1926 McEwing et al. ..... 362/153.1
4,223,377 A * 9/1980 Williams ..... 362/145
4,340,929 A * 7/1982 Konikoff et al. ..... 362/153
4,888,669 A * 12/1989 Hanson ..... 362/145
5,390,090 A * 2/1995 Nau ..... 362/153
5,683,170 A * 11/1997 Blaha ..... 362/145
5,806,263 A * 9/1998 Coleman ..... 52/306
6,082,886 A * 7/2000 Stanford ..... 362/576
6,116,751 A * 9/2000 Remp ..... 362/153

* cited by examiner

*Primary Examiner*—Ali Alavi
*Assistant Examiner*—Bao Q Truong
(74) *Attorney, Agent, or Firm*—John H. Crozier

(57) ABSTRACT

In a preferred embodiment, an illuminated glass deck light panel, including: a plurality of glass pavers, structural plank glass elements, or other structural lenses; a longitudinally extending support pan for embedding in a supporting substrate; the plurality of glass pavers, structural plank glass elements, or other structural lenses resting on ledges formed in the support pan; a sealing material disposed between the glass pavers, structural plank glass elements, or other structural lenses and the support pan; a plurality of illumination sources disposed in the support pan underneath the plurality of glass pavers, structural plank glass elements, or other structural lenses; and the plurality of illumination sources being at all times illuminated whenever one of the plurality of illumination sources is illuminated. The plurality of illumination sources may also be selected from the group consisting of: pulsed illumination sources, blinking illumination sources, and progressive illumination sources to direct persons in a certain direction.

20 Claims, 9 Drawing Sheets

ILLUMINATED GLASS DECK LIGHT PANEL AND METHOD OF INSTALLATION

CROSS-REFERENCE TO RELATED APPLICATION

The present application is a continuation-in-part of co-pending application Ser. No. 10/086,965, filed Mar. 4, 2002 now abandoned, and titled ILLUMINATED GLASS DECK LIGHT PANEL AND METHOD OF INSTALLATION, now abandoned.

BACKGROUND OF THE INVENTION

1. Field of the Invention

The present invention relates to lights generally and, more particularly, but not by way of limitation, to a novel illuminated glass deck light panel and method of installation.

2. Background Art

Known embedded glass paver lights are limited to individual lights. There is no known light assembly that can extend indefinitely or for any desired length.

Accordingly, it is a principal object of the present invention to provide an illuminated glass deck light panel that can extend to any desired length.

It is a further object of the invention to provide such an illuminated glass deck light panel that provides a sealed chamber.

It is an additional object of the invention to provide such an illuminated glass deck light panel that is rugged and fully stabilized so that the light panel can be used in driveways, for example.

It is another object of the invention to provide such an illuminated glass deck light panel that can be formed in a number of shapes.

It is yet a further object of the invention to provide a method of installation of such a light panel.

Other objects of the present invention, as well as particular features, elements, and advantages thereof, will be elucidated in, or be apparent from, the following description and the accompanying drawing figures.

SUMMARY OF THE INVENTION

The present invention achieves the above objects, among others, by providing, in a preferred embodiment, an illuminated glass deck light panel, comprising: a plurality of glass pavers, structural plank glass elements, or other structural lenses; a longitudinally extending support pan for embedding in a supporting substrate; said plurality of glass pavers, structural plank glass elements, or other structural lenses resting on ledges formed in said support pan; a sealing material disposed between said glass pavers, structural plank glass elements, or other structural lenses and said support pan; a plurality of illumination sources disposed in said support pan underneath said plurality of glass pavers, structural plank glass elements, or other structural lenses; and said plurality of illumination sources being at all times illuminated whenever one of said plurality of illumination sources is illuminated. Said plurality of illumination sources may also be selected from the group consisting of: pulsed illumination sources, blinking illumination sources, and progressive illumination sources to direct persons in a certain direction.

BRIEF DESCRIPTION OF THE DRAWING

Understanding of the present invention and the various aspects thereof will be facilitated by reference to the accompanying drawing figures, provided for purposes of illustration only and not intended to define the scope of the invention, on which.

DETAILED DESCRIPTION OF THE PREFERRED EMBODIMENTS

Figure 2:
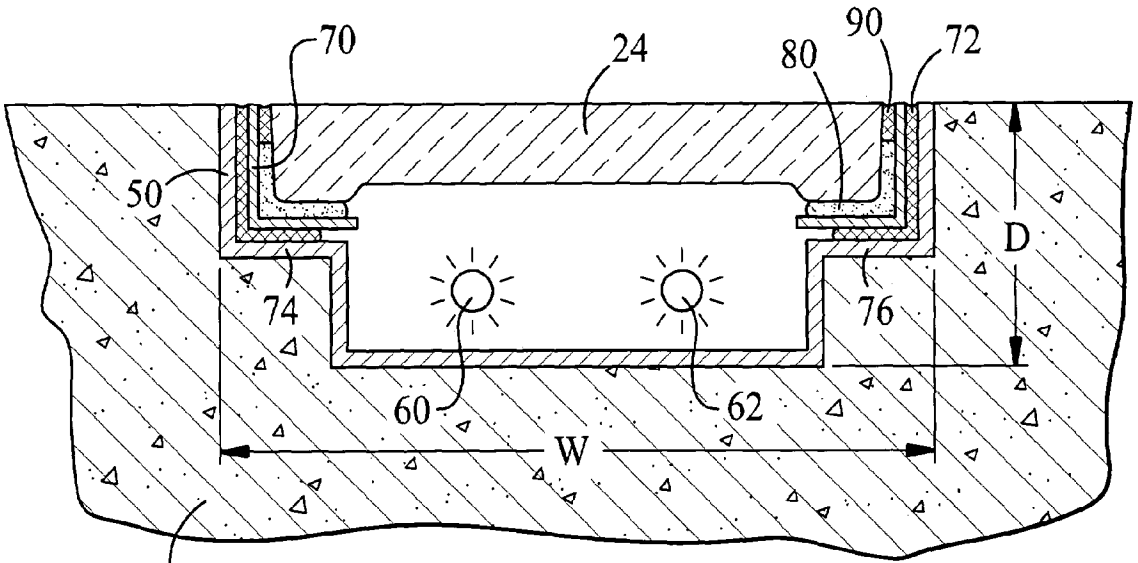
FIG. 2 is a fragmentary end elevational view, in cross-section, taken along line "2—2" of FIG. 1.

Reference should now be made to the drawing figures on which similar or identical elements are given consistent identifying numerals throughout the various figures thereof, and on which parenthetical references to figure numbers, when used, direct the reader to the view(s) on which the element(s) being described is (are) best seen, although the element(s) may be seen on other figures also.

Figure 1:
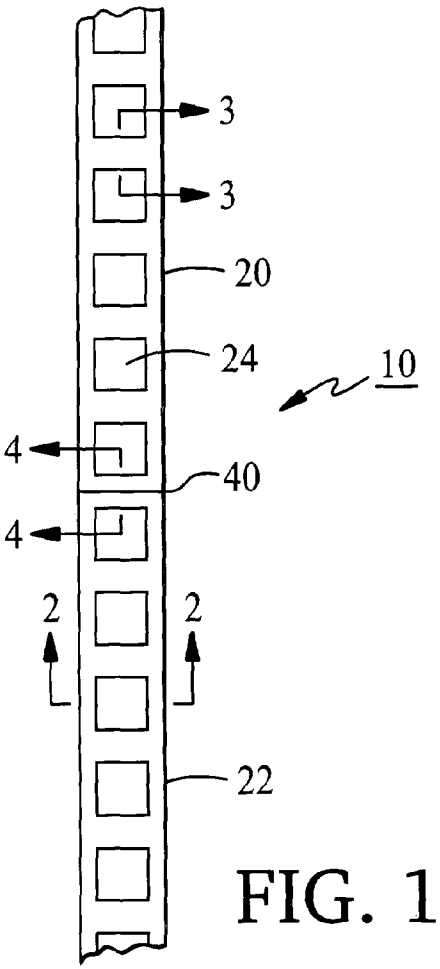
FIG. 1 is a top plan view of an illuminated glass deck light panel constructed according to the present invention.

FIG. 1 illustrates a portion of an illuminated glass deck light panel, constructed according to the present invention, and generally indicated by the reference numeral 10. Light panel 10 includes two elongated support pans 20 and 22 in which are disposed pluralities of illuminated glass blocks, as at 24, which may be glass pavers, structural glass planks, or other structural lenses, the details of which light panel are described below. Support pans 20 and 22 have a common joint 40 and may have dimensions of about one-inch to 12-inches wide by about four feet long, although other dimensions may be provided as well. Also, it is not necessary that support pans 20 and 22 be straight as shown, but may be curved and/or may be joined at an angle. Although any desired dimensions may be provided, "W" on FIG. 2 may be about 6-¼ inches and "D" may be about 2-¾ inches.

FIG. 2 illustrates illuminated light panel 10 and illustrates some of the details of the construction thereof. Light panel 10 includes a horizontally extending upwardly open, generally channel-shaped support pan 50 embedded in a supporting substrate 52, the substrate in this case shown as being concrete. The substrate could also be any material in which it is desired to embed the light panel such as soil or support pan 50 could be framed into wood or masonry construction or it may be placed on any supporting structure. Support pan 50 may be constructed of extruded aluminum or formed from steel, for example, or constructed of any other suitable material. Two longitudinally extending illumination sources 60 and 62 are disposed lengthwise in the bottom of support pan 50. Illumination sources 60 and 62 may be light cables, fiber optic cables, or strings of fluorescent or incandescent light bulbs, for example. Of course, a greater or a lesser number of illumination sources may be provided, depending on the application. The bottom of support pan 50 underlying illumination sources 60 and 62 may be coated with paint or other suitable white or colored material.

A longitudinally extending glass panel assembly support frame 70 is attached to support pan 50 by means of a layer 72 of silicone caulking material, or other appropriate sealant, disposed between bottom surfaces of glass panel assembly support frame and horizontal ledges 74 and 76 formed in the support pan. Glass paver 24 (FIG. 1) is inserted in glass panel assembly support frame 70 and sealed thereto by means of a cemetitious material 80, or other appropriate setting material, covering horizontal bottom portions and most of the vertical sides of the glass paver. A bead 90 of silicone caulking material is placed along the top of cemetitious material 80 between glass paver 24 and glass panel assembly support frame 70 for waterproofing.

Illumination sources 60 and 62 do not intrude on or otherwise interfere with glass pavers 24 and support pan 50 provides a sealed true and controlled environment that is essential for paving glass performance. Illumination sources 60 and 62 may have the capability of being pulsed, or blinking, or progressive to direct or aim people in a certain direction, as well as being continuously illuminated.

Figure 3:
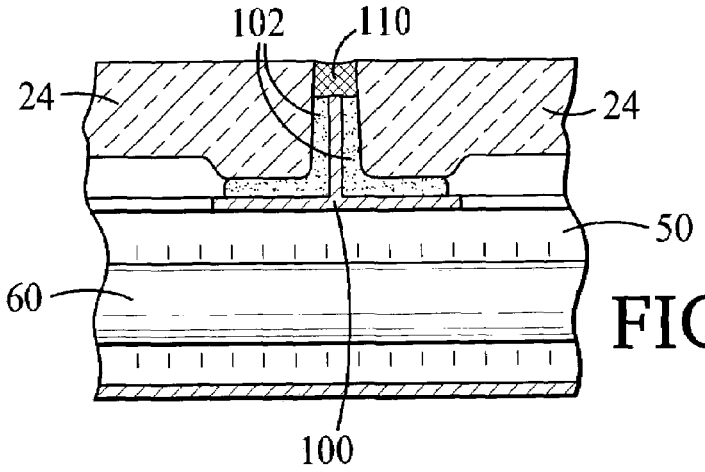
FIG. 3 is a fragmentary side elevational view, in cross-section, taken along line "3—3" of FIG. 1.

FIG. 3 illustrates the joining of adjacent glass pavers 24 (FIG. 1). Here, an intermediate inverted T-shaped form 100 is disposed between adjacent glass pavers and joined to the glass pavers by means of a cemetitious material 102 in a manner similar to the joining of glass paver 24 to glass panel assembly support frame 70 (FIG. 2). A bead 110 of silicone caulking material is provided at the top of cemetitious material 102 and intermediate inverted T-shaped form 100 for waterproofing.

Figure 4:
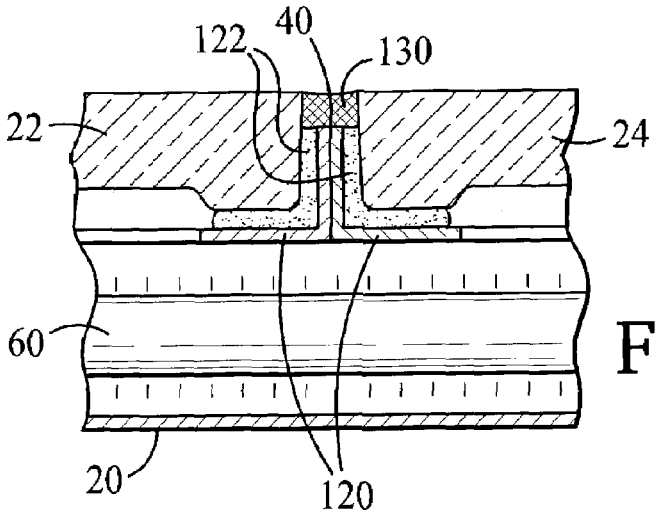
FIG. 4 is a fragmentary side elevational view, in cross-section, taken along line "4—4" of FIG. 1.

FIG. 4 illustrates the joining of adjacent sections 22 and 24 (FIG. 1). Here, the joining method is essentially the same as that illustrated on FIG. 3, except that L-shaped forms 120 are placed at the ends of sections 22 and 24 and are joined together by means of a cemetitious material 122 placed therebetween. A bead 130 of silicone caulking material is placed at the top of cemetitious material 122 for waterproofing.

Figure 5:
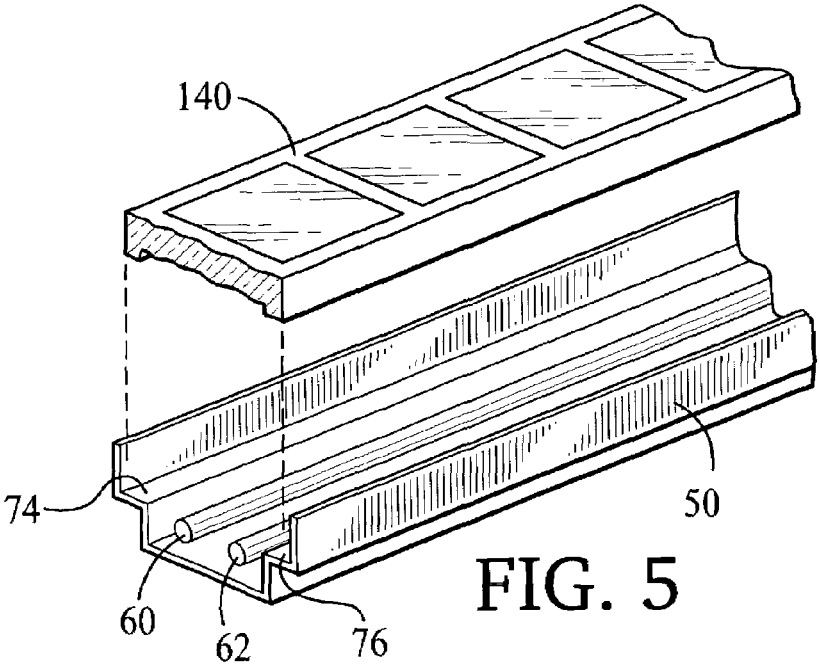
FIG. 5 is a fragmentary isometric view of a glass panel assembly being inserted in a support pan.

FIG. 5 illustrates a longitudinally extending glass panel assembly 140 being lowered into support pan 50, with illumination cables 60 and 62 disposed in the bottom of the latter.

Figure 6:
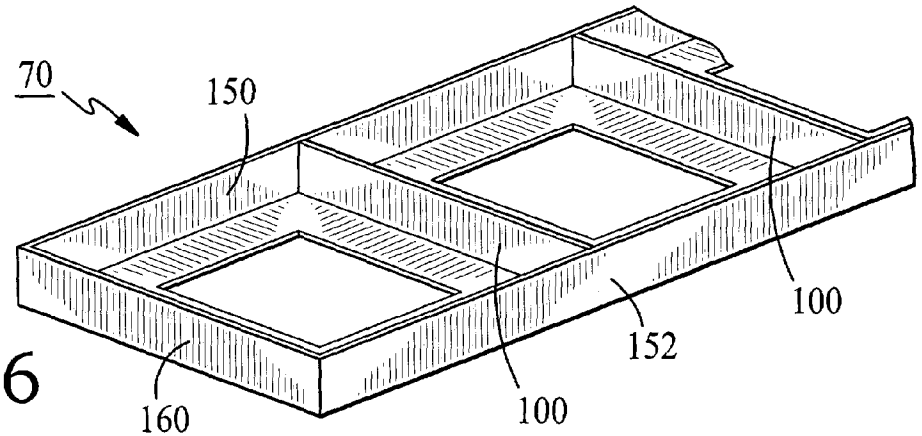
FIG. 6 is a fragmentary isometric view of an end portion of a glass panel assembly support frame.

FIG. 6 illustrates the construction of glass panel assembly support frame 70. First and second L-shaped members 150 and 152 are provided as sides of glass panel assembly support frame and are joined to suitably notched intermediate inverted T-shaped forms 100. A suitably notched end L-shaped form 160, parallel to T-shaped forms 100, is provided as the end of glass panel assembly support frame 70. The members of glass panel assembly support frame 70 may be extruded or formed of suitable material and attached together by means of welding or by other suitable means depending on the material of construction. The bottom surfaces of the members of glass panel assembly support frame 70 lie in a common, horizontal plane.

Figure 7:
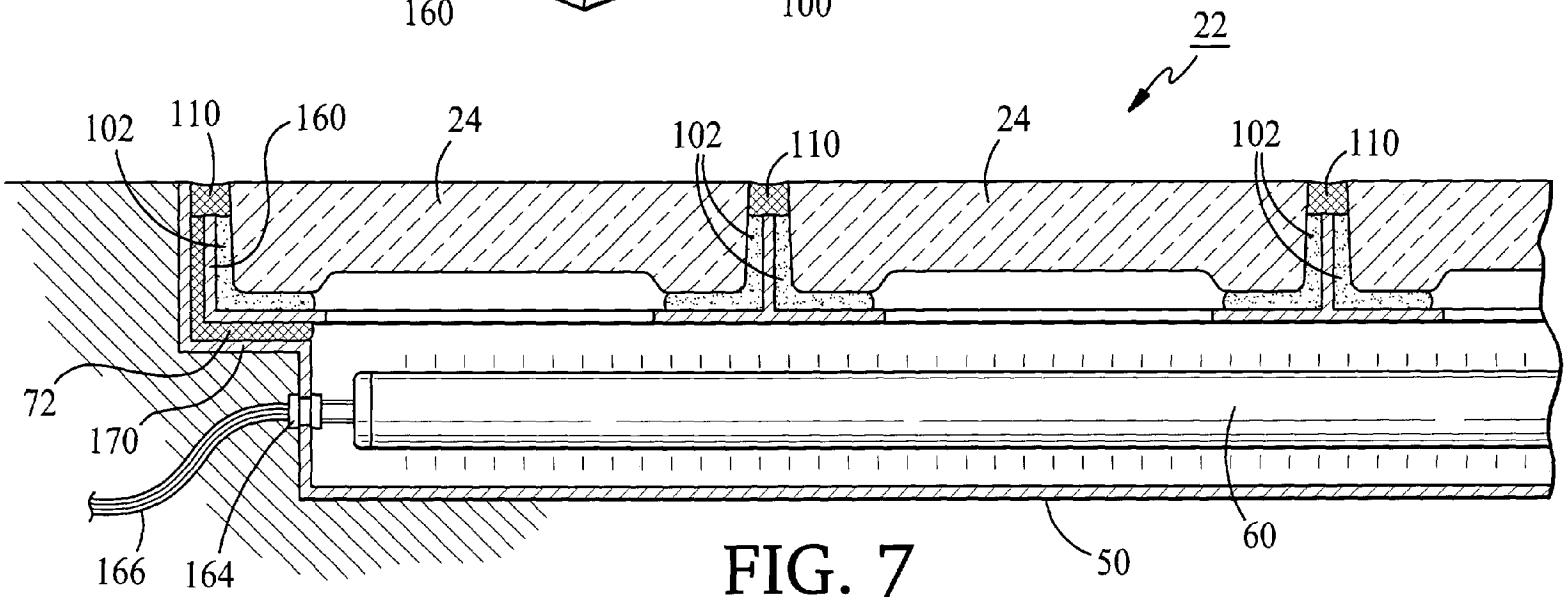
FIG. 7 is a fragmentary side elevational view of an end portion of an illuminated glass deck light panel constructed according to the present invention.

FIG. 7 illustrates the end of section 22 (FIG. 1) and illustrates that L-shaped form 160 rests on a horizontal ledge 170 formed in bottom pan 50. The bottom surface of L-shaped form 160 also lies in the same plane as that of the other members of glass panel support frame 70 (FIG. 6). FIG. 7 also illustrates that illumination source 60 is connected to a power source (not shown) through a waterproof connector 164 attached to a waterproof conduit 166.

In construction, support pan 50 (FIG. 2) is embedded in substrate 52. Then, illumination sources 60 and 62 are placed therein and wired. Before or after placing of illumination sources 60 and 62, temporary Styrofoam blocks, or other appropriate infill material, may be inserted into support pan 50 to provide a smooth surface for other construction activities. Finally, the Styrofoam, or other appropriate infill material, (if used) is removed, silicone or other suitable caulking material 72 (FIG. 2) is placed on horizontal ledges 74 and 76 and the vertical inner upper surfaces of support pan 50 and on horizontal ledge 170 (FIG. 7) of the support pan, and prefabricated glass panel assembly 140 (FIG. 5) is lowered into the support pan. When it is necessary or desirably to replace illumination sources 60 and 62, silicone or other suitable caulking material 72 is cut and glass panel assembly 140 removed. After replacement of illumination sources 60 and 62, glass panel assembly 140 can be rebedded in support pan 50.

Figure 8:
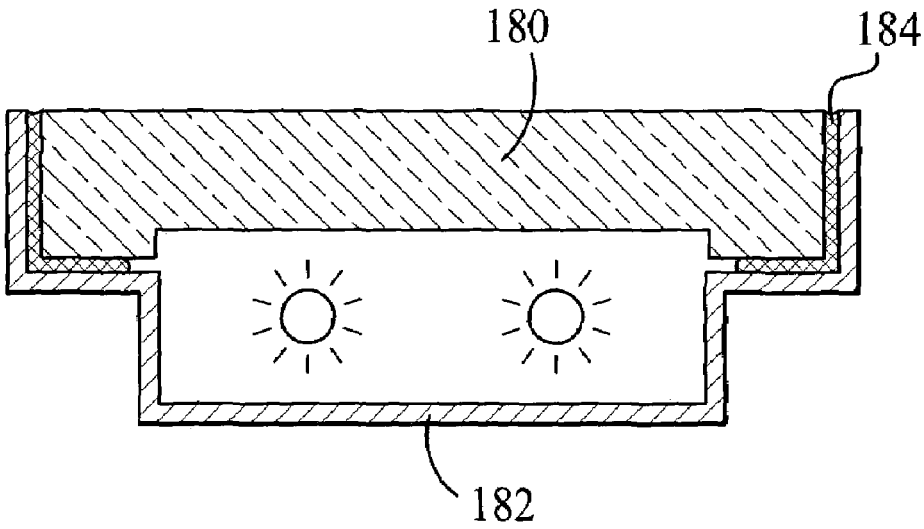
FIG. 8 is an end elevational view, in cross-section, of a glass paver glazed directly to a support pan.

FIG. 8 illustrates that a glass paver 180 may be glazed directly to a support pan 182, with silicone caulking material 184 placed between the glass paver and the support pan.

Figure 8A:
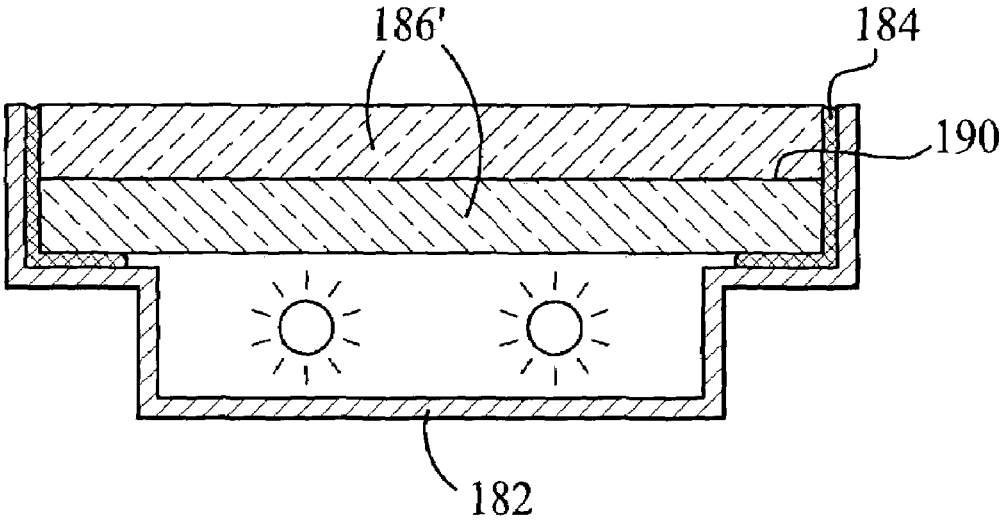
FIG. 8(A) is identical to FIG. 8, except that layers of structural plank glass have been substituted for the glass paver.

FIG. 8(A) illustrates that two layers of structural plank glass 186' may be substituted for glass paver 180 (FIG. 8). Here, the two layers of structural plank glass 186' are separated by a suitable laminate 190, such as polycarbonate. More than two layers of structural plank glass may be provided if desired and depending on the application.

Figure 9:
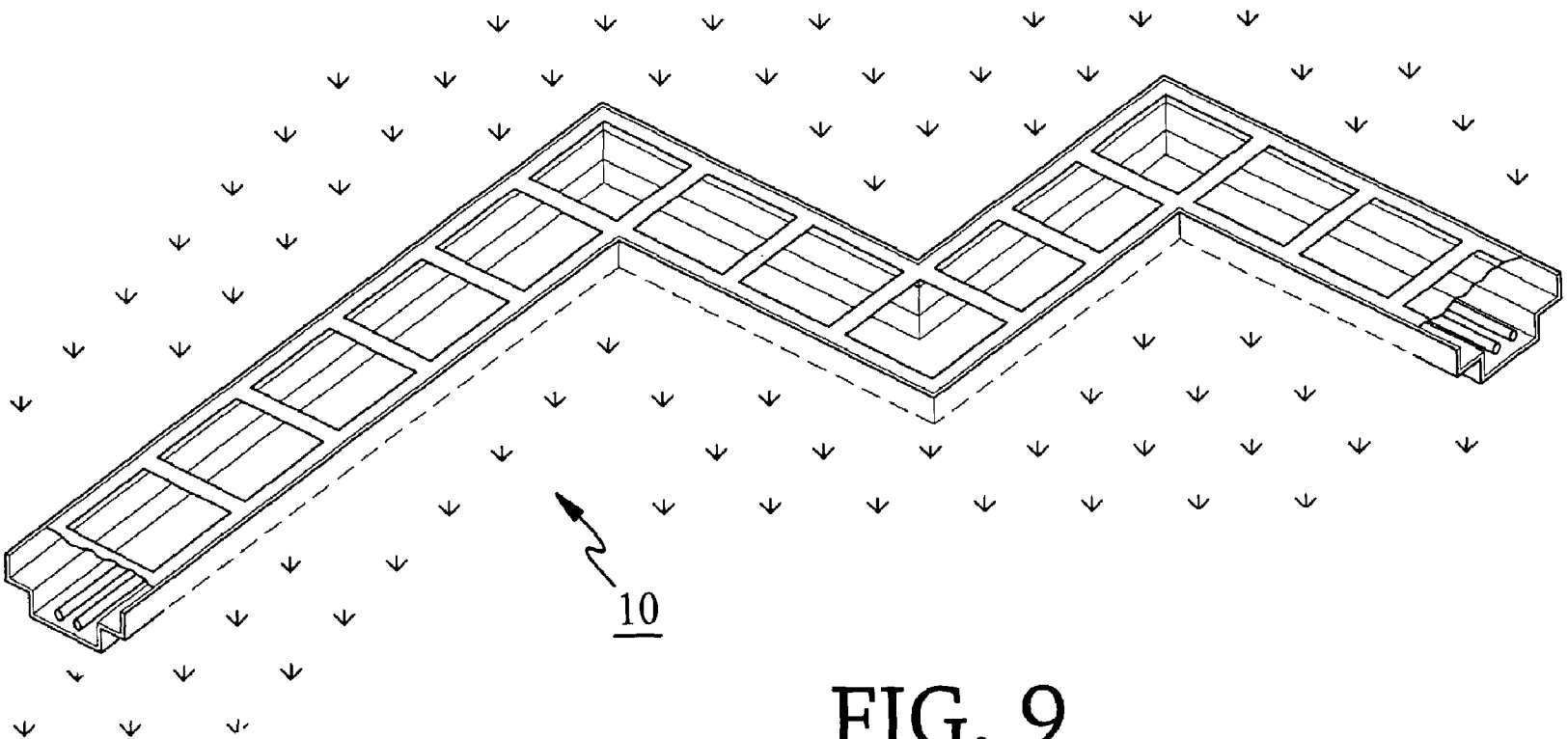
FIG. 9 is an isometric view of a light panel in a continuous non-linear pattern.

FIG. 9 illustrates illuminated glass deck light panel 10 applied in a continuous non-linear manner.

Figure 10:
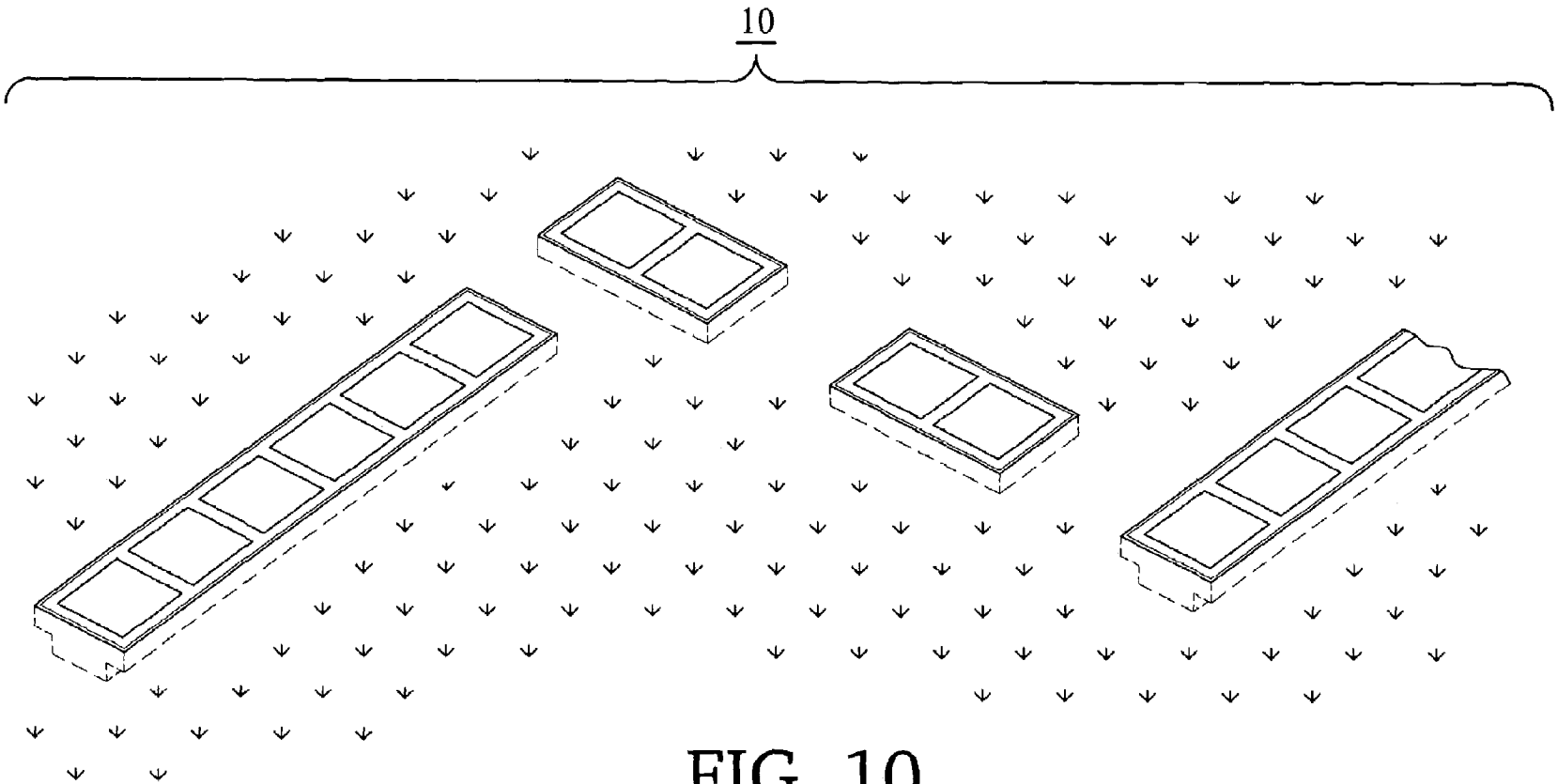
FIG. 10 is an isometric view of a light panel in a non-continuous non-linear pattern.

FIG. 10 illustrates illuminated glass deck light panel 10 applied in a non-continuous non-linear manner.

Figure 11:
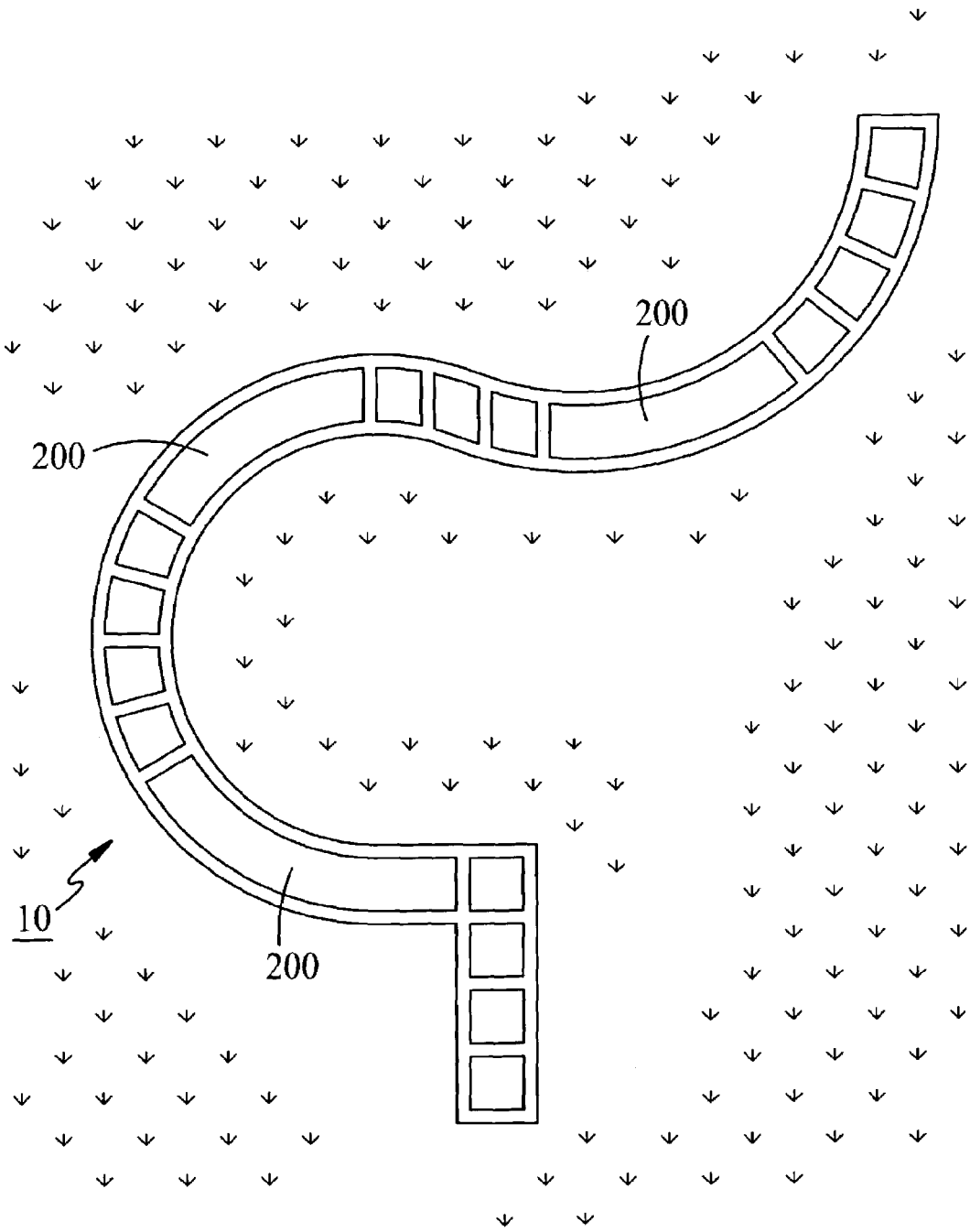
FIG. 11 is a top plan view of a light panel having arcuate elements.

FIG. 11 illustrates that glass deck light panel 10 may have arcuate elements, here, elements 200 that are formed of curved structural plank glass or other structural lenses.

Illuminated glass deck light panel 10 is fully stabilized and may be used in sidewalks (where it can be walked upon), driveways (where it can be driven over by vehicles), decks, and/or for accent lighting, etc. It can provide accent, mood, security, or other type of lighting. The light panel can be supplied in a variety of standard lengths which would be job site joined to accommodate any length of shape requirements and can be designed for any load.

Figure 12:
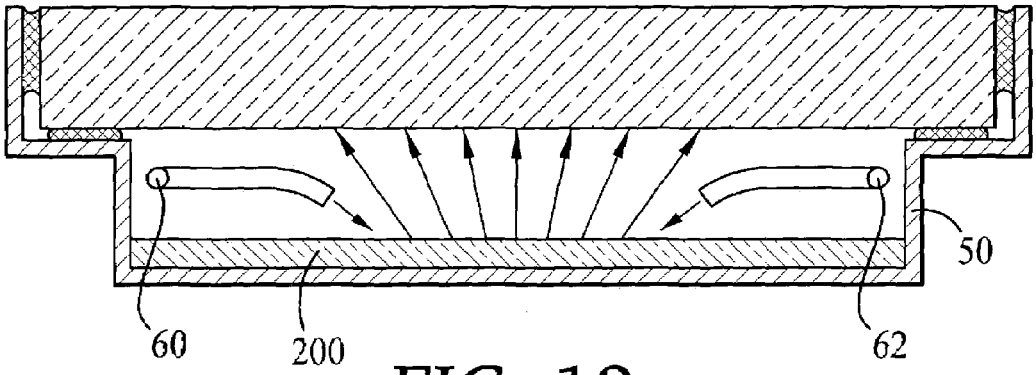
FIG. 12 is an end elevational view, in cross-section, of one embodiment of a light panel.

FIG. 12 illustrates that illumination sources 60 and 62 can be fiber optic or rope light cables, with a reflective surface 200 disposed on the bottom of support pan 50. Reflective surface 200 can be, for example, plastic, glass, mylar, a mirror, or prisms, or any other suitable reflective material.

Figure 13:
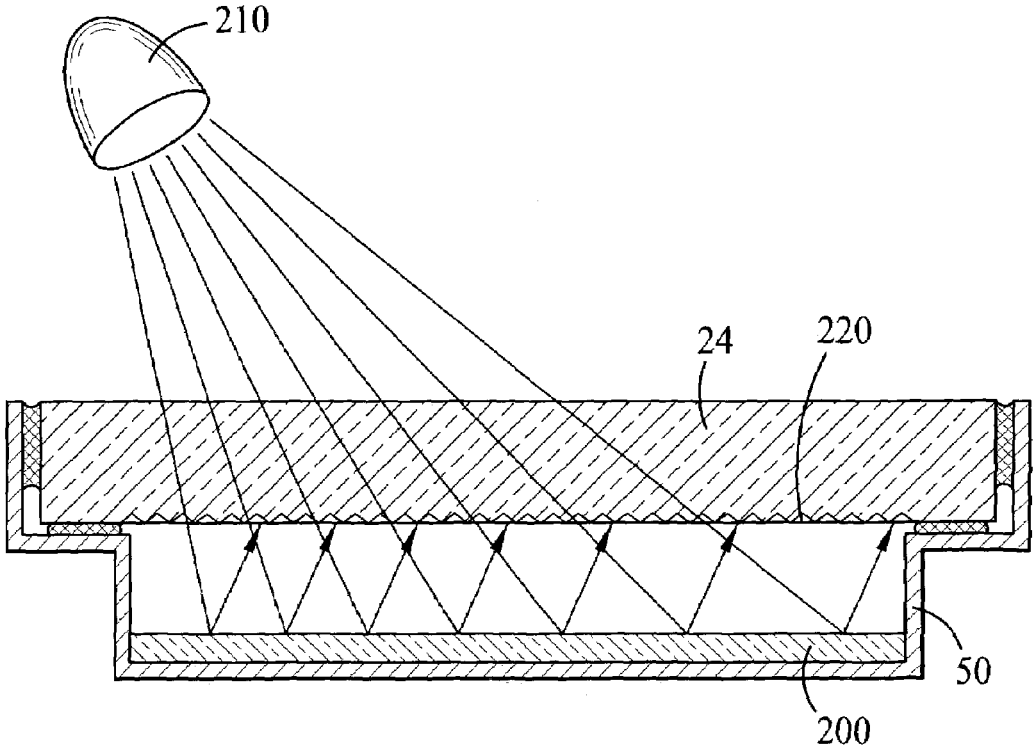
FIG. 13 is an end elevational view, in cross-section, of another embodiment of a light panel.

FIG. 13 illustrates that illumination can be provided from external light source 210 disposed above glass block 24 and reflected from reflective material 200 disposed on support pan 50. In this case, the bottom surface 220 of glass block 24 is sandblasted or formed of prismatic glass to give the appearance that the glass block is illuminated from below. External light source may be, for example, a fluorescent or incandescent light or may be solar.

Figure 14:
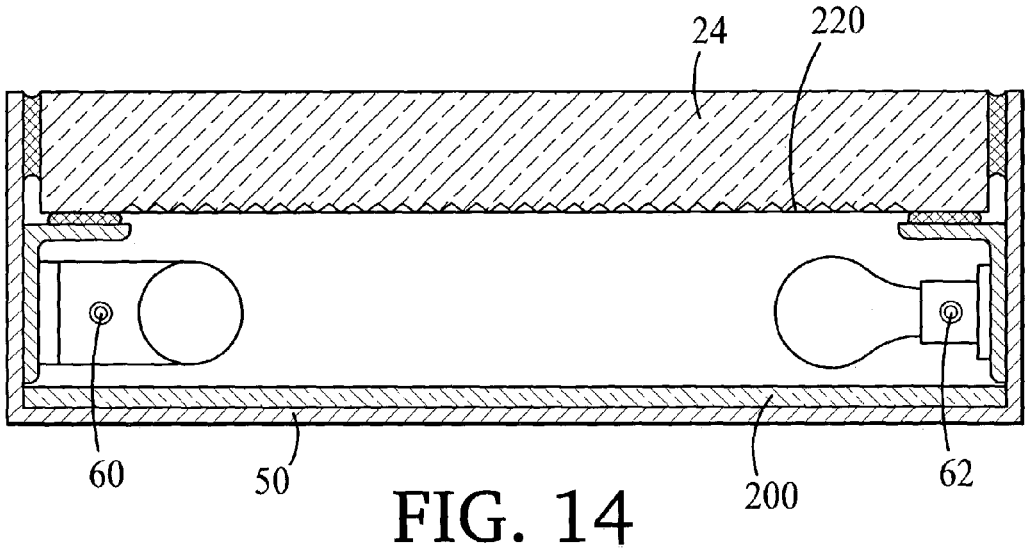
FIG. 14 is an end elevational view, in cross-section, of an additional embodiment of a light panel.

FIG. 14 illustrates that illumination sources 60 and 62 can be a string of incandescent light bulbs, disposed either as shown for illumination source 60 or illumination source 62. The under surface 220 of glass block 24 may be sandblasted or provided with prismatic glass and/or a reflective surface 200 may be disposed on the bottom of support pan 50.

Figure 15:
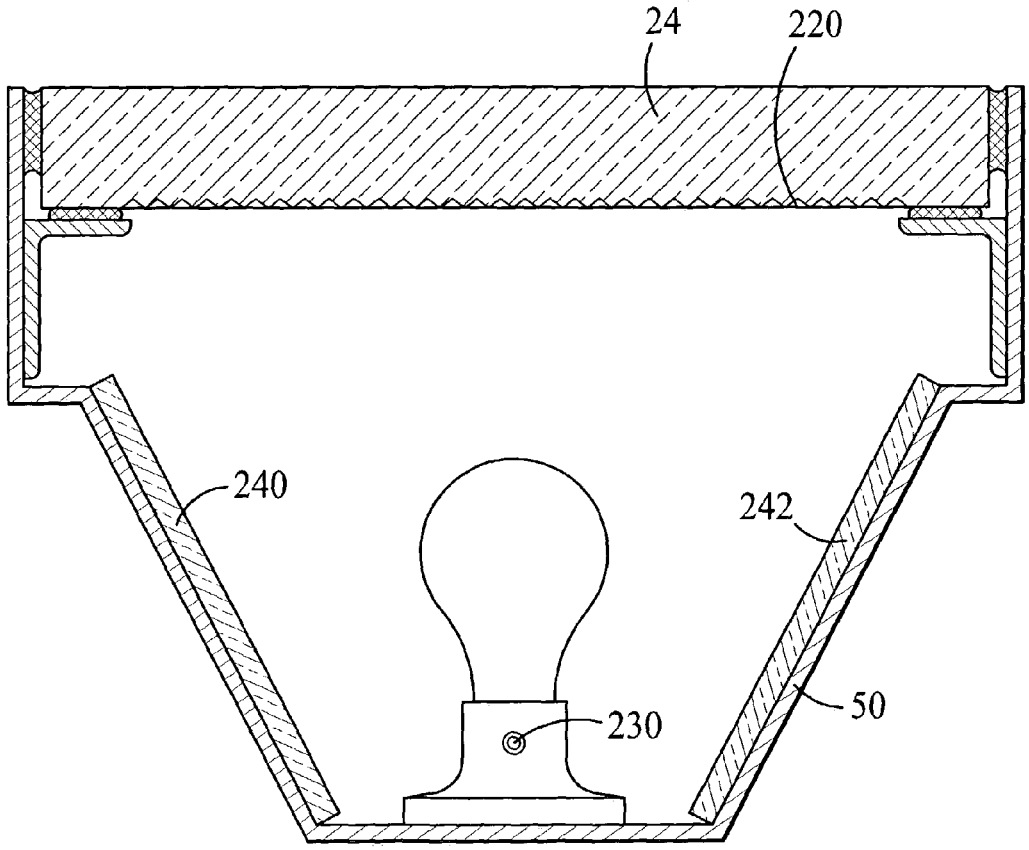
FIG. 15 is an end elevational view, in cross-section, of a further embodiment of a light panel.

FIG. 15 illustrates that support pan 50 can have sloped sides, with illumination source 230 disposed at the bottom of the support pan. The sloped sides of support pan 50 may have one or both layers 240 and 242 of reflective material disposed thereon and/or the bottom surface 220 of glass block 24 may be sandblasted or provided with prismatic glass.

In the embodiments of the present invention described above, it will be recognized that individual elements and/or features thereof are not necessarily limited to a particular embodiment but, where applicable, are interchangeable and can be used in any selected embodiment even though such may not be specifically shown.

Spatially orienting terms such as "above", "below", "upper", "lower", "inner", "outer", "inwardly", "outwardly", "vertical", "horizontal", and the like, when used herein, refer to the positions of the respective elements shown on the accompanying drawing figures and the present invention is not necessarily limited to such positions.

It will thus be seen that the objects set forth above, among those elucidated in, or made apparent from, the preceding description, are efficiently attained and, since certain changes may be made in the above construction and method without departing from the scope of the invention, it is intended that all matter contained in the above description or shown on the accompanying drawing figures shall be interpreted as illustrative only and not in a limiting sense.

It is also to be understood that the following claims are intended to cover all of the generic and specific features of the invention herein described and all statements of the scope of the invention that, as a matter of language, might be said to fall therebetween.

The invention claimed is:

1. An illuminated glass deck light panel, comprising:

(a) a plurality of load-bearing glass pavers, structural plank glass elements, or other structural lenses of like type, said plurality of load-bearing glass pavers, structural plank glass elements, or other structural lenses of like type being horizontally disposed;

(b) a longitudinally extending support pan for embedding in a supporting substrate;

(c) said plurality of load-bearing glass pavers, structural plank glass elements, or other structural lenses of like type resting on ledges formed in said support pan;

(d) a sealing material disposed between said load-bearing glass pavers, structural plank glass elements, or other structural lenses of like type and said support pan;

(e) a plurality of illumination sources disposed in said support pan underneath said plurality of load-bearing glass pavers, structural plank glass elements, or other structural lenses of like type, said plurality of illumination sources directing light upwardly through said plurality of load-bearing glass pavers, structural plank glass elements, or other structural lenses of like type; and (f) said plurality of illumination sources being at all times illuminated whenever one of said plurality of illumination sources is illuminated.

2. The illuminated glass deck light panel, as defined in claim 1, wherein: interior of said support pan defined between inner surfaces of said support pan and inner surfaces of said plurality of load-bearing glass pavers, structural plank glass elements or other structural lenses of like type is permanently sealed.

3. The illuminated glass deck light panel, as defined in claim 1, a support frame disposed between and sealed to said plurality of load-bearing glass pavers, structural plank glass elements, or other structural lenses of like type and said support pan.

4. The illuminated glass deck light panel, as defined in claim 1, wherein: said illuminated glass deck light panel is continuous and non-linear.

5. The illuminated glass deck light panel, as defined in claim 1, wherein: said illuminated glass deck light panel is non-continuous and non-linear.

6. The illuminated glass deck light panel, as defined in claim 1, wherein: said support pan is arcuate.

7. The illuminated glass deck light panel, as defined in claim 1, wherein: a reflective surface is disposed at a bottom of said support pan.

8. The illuminated glass deck light panel, as defined in claim 1, wherein: a bottom surface of said load-bearing glass pavers, structural plank glass elements, or other structural lenses of like type is sandblasted or is formed of prismatic glass.

9. The illuminated glass deck light panel, as defined in claim 1, further comprising: a second plurality of load-bearing glass pavers, structural plank glass elements, or other structural lenses is disposed on top of said plurality of load-bearing glass pavers, structural plank glass elements, or other structural lenses.

10. The illuminated glass deck light panel, as defined in claim 9, further comprising: a suitable laminate disposed between said plurality and said second plurality.

11. The illuminated glass deck light panel, as defined in claim 1, wherein: sides of said support pan are sloped such that said support pan is wider at a top thereof than at a bottom thereof.

12. The illuminated glass deck light panel, as defined in claim 11, wherein: one or both sides of said support pan have a reflective material disposed thereon.

13. A method of installing an illuminated glass deck light panel, comprising:

(a) embedding a longitudinally extending support pan in a supporting substrate;

(b) placing a plurality of illumination sources in a bottom of said support pan, said plurality of illumination sources being at all times illuminated whenever one of said illumination sources is illuminated, said plurality of illumination sources directing light upward through a plurality of load-bearing glass pavers, structural plank glass elements, or other structural lenses of like type;

(c) placing a sealing material on ledges formed on said support pan; and (d) placing said plurality of load-bearing glass pavers, structural plank glass elements, or other structural lenses of like type on said ledges, said plurality of load-bearing glass pavers, structural plank glass elements, or other structural lenses of like type being horizontally disposed.

14. The method of installing an illuminated glass deck light panel, as defined in claim 13, further comprising: forming a permanently sealed chamber defined between inner surfaces of said support pan and inner surfaces of said plurality of load-bearing glass pavers, structural plank glass elements, or other structural lenses of like type.

15. The method of installing an illuminated glass deck light panel, as defined in claim 13, further comprising: placing a support frame between and sealing to said plurality of load-bearing glass pavers, structural plank glass elements, or other structural lenses of like type and said support pan.

16. The method of installing an illuminated glass deck light panel, as defined in claim 13, further comprising: prior to step (b) or step (c), installing temporary infill blocks in said support pan to provide a smooth surface for other construction activities; and removing said infill blocks before step (d).

17. The method of installing an illuminated glass deck light panel, as defined in claim 16, wherein: said infill blocks are styrofoam blocks.

18. An illuminated glass deck light panel, comprising:

(a) a plurality of load-bearing glass pavers, structural plank glass elements, or other structural lenses;

(b) a longitudinally extending support pan for embedding in a supporting substrate;

(c) said plurality of load-bearing glass pavers, structural plank glass elements, or other structural lenses of like type resting on ledges formed in said support pan;

(d) a sealing material disposed between said glass pavers, structural plank glass elements, or other structural lenses and said support pan; and (e) a reflective material disposed in support pan underneath said plurality of load-bearing glass pavers, arranged so as to reflect light from a light source disposed above said plurality of load-bearing glass pavers, structural plank glass elements, or other structural lenses to give the appearance that said plurality of load-bearing glass pavers, structural plank glass elements, or other structural lenses are illuminated from below.

19. The illuminated glass deck light panel, as defined in claim 18, wherein: a bottom surface of said load-bearing glass pavers, structural plank glass elements, or other structural lenses of like type is sandblasted or is formed of prismatic glass.

20. An illuminated glass deck light panel, comprising:

(a) a plurality of load-bearing glass pavers, structural plank glass elements, or other structural lenses of like type;

(b) a longitudinally extending support pan for embedding in a supporting substrate;

(c) said plurality of load-bearing glass pavers, structural plank glass elements, or other structural lenses of like type resting on ledges formed in said support pan;

(d) a sealing material disposed between said load-bearing glass pavers, structural plank glass elements, or other structural lenses of like type and said support pan;

(e) a plurality of illumination sources disposed in said support pan underneath said plurality of load-bearing glass pavers, structural plank glass elements, or other structural lenses of like type, said plurality of illumination sources directing light upwardly through said plurality of load-bearing glass pavers, structural plank glass elements, or other structural lenses of like type; and (f) said plurality of illumination sources being selected from the group consisting of: pulsed illumination sources, blinking illumination sources, and progressive illumination sources to direct persons in a certain direction.

* * * * *